US005669232A

United States Patent [19]

Iwamoto et al.

[11] Patent Number: 5,669,232

[45] Date of Patent: Sep. 23, 1997

[54] REFRIGERATING UNIT

[75] Inventors: Keiichi Iwamoto, Oizumi-machi; Yukinobu Nishikawa, Higashiosaka, both of Japan

[73] Assignee: Sanyo Electric Co., Ltd., Osaka-fu, Japan

[21] Appl. No.: 560,482

[22] Filed: Nov. 17, 1995

[30] Foreign Application Priority Data

| | | | |
|---|---|---|---|
| Nov. 22, 1994 | [JP] | Japan | 6-311276 |
| Nov. 25, 1994 | [JP] | Japan | 6-314236 |
| May 29, 1995 | [JP] | Japan | 7-152723 |
| May 29, 1995 | [JP] | Japan | 7-152724 |

[51] Int. Cl.[6] ..... F25D 23/04; F25B 1/00

[52] U.S. Cl. ..... 62/296; 62/505; 312/406

[58] Field of Search ..... 62/296, 297, 298, 62/505; 312/401, 404, 406

[56] References Cited

U.S. PATENT DOCUMENTS 3,548,612 12/1970 Mitsubayashi et al. ..... 62/505

FOREIGN PATENT DOCUMENTS

| | | |
|---|---|---|
| 4716427 | 6/1972 | Japan . |
| 5340724 | 10/1978 | Japan . |
| 113822 | 4/1989 | Japan . |
| 6194027 | 7/1994 | Japan . |
| 6229660 | 8/1994 | Japan . |

*Primary Examiner*—William Doerrler

*Attorney, Agent, or Firm*—Weingarten, Schurgin, Gagnebin & Hayes LLP

[57] ABSTRACT

A refrigerating unit comprising an adiabatic box provided with a door to its opening, a machine compartment in contact with said adiabatic box, and a refrigerating cycle wherein the machine compartment is covered with a damping plate and is attached to the adiabatic box with a jointing means so as to be sealed, and further said refrigerating unit comprises an oil cooler for cooling lubricating oil in a compressor in the refrigerating cycle is provided. By this, noise and vibration generated by a refrigerator itself such as noise generated by a flowing or boiling refrigerant in the compressor and an evaporator can be effectively removed, noise and vibration generated by resonance between vibration by a refrigerator and a wall or a cabinet can be attenuated and the effect of heat release can be enhanced. It is preferable that an outer casing of the adiabatic box is also made of a damping plate or a damping material is stuck to important positions of the outer casing made of an iron plate after forming an iron plate. Noise generated by a flowing or boiling refrigerant in the evaporator can be absorbed in a sound absorbing material layer and can be effectively attenuated by also providing a sound absorbing material layer between a heat insulator in the adiabatic box and the inner casing and between a heat insulator in the door and the door panel.

13 Claims, 9 Drawing Sheets

REFRIGERATING UNIT

BACKGROUND OF THE INVENTION

1. Field of the Invention

The present invention relates to a refrigerating unit, further in detail to a refrigerating unit by which noise and vibration are reduced, resonance between a refrigerator add a wall or a cabinet is reduced and comfort is provided in a bedroom and so on in which a refrigerator is installed.

2. Background Art

Referring to the conventional refrigerator for use in a home, a hotel or an inn, or for business use, the box-type body is constituted by an adiabatic wall, a machine compartment is provided, for example in the lower part of the body and a compressor constituting a part of a refrigerating cycle is mounted in this machine compartment.

However, as a compressor is vibrated by drive of a motor and the inside is under high pressure, relatively large noise is generated. Particularly, as a machine compartment communicates with the outside, noise from a compressor such as noise generated when the motor of the compressor is rotated, noise generated when lubricating oil is stirred, noise generated by a refrigerant and noise generated by resonance of pipelines for a refrigerating cycle is communicated to the outside as it almost is, and therefore, a problem that such a refrigerator generates extremely harsh noise occurs in a home, a hotel and an inn.

In the meantime, as such a compressor is normally driven by the motor, it is heated by heat loss generated by the motor when refrigerating operation is performed, heat generated by friction between machine parts or heat conducted from a compression refrigerant.

Hitherto such a device as making a hole through a base on which a compressor was mounted and making a slit on a cover to shut a machine compartment was generally made so that a machine compartment communicated with the outside because a failure such as sticking of machine parts and burning of motor wiring might occur when the temperature of a compressor was extraordinarily high by such heat, and heat release from a compressor was promoted by ventilating a machine compartment with a blower provided in the machine compartment.

For example, a noise-proof case consisting of a sound absorbing material and a radiation fin for soundproofing and heat release is put on a compressor as disclosed in Japanese utility model publication No. 47-16427, a heat releasing and soundproofing device consisting of a capillary member including sufficient water is similarly put on a compressor so that the similar soundproofing and heat releasing effect can be produced as disclosed in Japanese utility model publication No. 53-40724, and a sound absorbing material consisting of an elastic aggregate and a thermal conductive sealer is wound around a compressor so as to radiate heat efficiently and reduce noise as disclosed in Japanese utility model publication No. 1-13822.

However, an area in which heat is released is limited because the above-described conventional soundproofing and heat releasing measures are taken only around a compressor, and therefore the capacity of heat radiation from a compressor is also limited.

Also, a machine compartment is covered and sealed with a blocking member and a heat transfer member mounted around the body of a compressor for heat exchange and extended outside the machine compartment so as to cool the member by air is provided as disclosed in Japanese patent Laid-open publication No. 6-194027, or a machine compartment is covered and sealed with a noise insulating member, the heat receiving side of a thermosiphon is mounted around the body of a compressor for heat exchange and the heat releasing side of the thermosiphon is mounted on a heat transfer member in the machine compartment for heat exchange as disclosed in Japanese patent Laid-open publication No. 6-229660.

However, as noise of a refrigerator installed in a bedroom, or a guest room of a hotel or an inn is made by the refrigerator itself such as vibration of the compressor and by resonance between vibration of the refrigerator and a wall and between vibration of the refrigerator and a cabinet on which the refrigerator is installed, a problem that the above-described soundproofing and heat releasing measures are not enough to remove noise generated by resonance between vibration of the refrigerator and a wall or a cabinet and have limitations occurs. There is also a problem such as noise generated by a flowing refrigerant and noise generated when a refrigerant is vaporized in a cooler in a refrigerator.

In the meantime, referring to the conventional refrigerant used for a refrigerator, dichlorodifluoromethane (R-12) or R-502 as an azeotropic mixed refrigerant comprising R-12 and 1,1-difluoroethane (R-152a) is suitable for a normal refrigeration unit, and a refrigerating cycle using lubricating oil such as mineral oil or alkylbenzene oil has high reliability and durability.

However, the above-described refrigerants have strong ozone destroying latent power and destroy an ozone layer when they are released in the air and reach an ozone layer over the earth. Destruction of an ozone layer is caused by a chlorine (Cl) in a refrigerant. A refrigerant including little chlorine, for example, chlorodifluoromethane (HCFC-22, R-22), difluoromethane (HFC-32, R-32), pentafluoroethane (HFC-125, R-125), 1,1,1,2-tetrafluoroethane (HFC-134a, R-134a) or a mixture of these is discussed as a substitutive refrigerant of these. Lubricating oil used for these HFC refrigerants includes mineral oil or alkylbenzene oil with little compatibility with HFC refrigerants, ester lubricating oil or ether lubricating oil or mixed oil thereof compatible with HFC refrigerants.

The development of a refrigerating unit using a refrigerant mainly consisting of such a HFC (hydrofluorocarbon) refrigerant or a HC (hydrocarbon) refrigerant such as propane, butane and pentane wherein noise is effectively removed and the efficiency of heat release is enhanced has been desired.

The present invention is made to solve such problems of the prior art, and the object of the present invention is to provide a refrigerating unit wherein noise generated by a refrigerator itself such as noise generated by a flowing or boiling refrigerant in a compressor or an evaporator is effectively attenuated, noise generated by resonance caused due to vibration between a refrigerator and a wall or a cabinet or noise generated by a flowing or boiling refrigerant by a cooler in a refrigerator is attenuated, and the efficiency of heat release is enhanced.

SUMMARY OF THE INVENTION

The inventors of the present invention found that the above-described problems can be solved by covering and sealing a machine compartment with a damping plate, attaching the machine compartment to the above-described adiabatic box with a screw and providing an oil cooler for cooling lubricating oil in a compressor, preferably by also constituting an outer casing of the adiabatic box by a damping plate or sticking a damping plate or a damping material such as resin or rubber to an outer casing constituted by an iron plate, or preferably by providing a sound absorbing material layer between a heat insulator in the adiabatic box and an inner casing of the adiabatic box or between a heat insulator in a door and a panel of the door as a result of laborious research to solve the above-described problems, and completed the present invention.

The object of the present invention is to provide a refrigerating unit comprising an adiabatic box provided with a door to its opening, a machine compartment in contact with said adiabatic box, and a refrigerating cycle, wherein said machine compartment is covered with a damping plate and is attached to said adiabatic box with a mounting means so as to be sealed and said refrigerating unit further comprises an oil cooler for cooling lubricating oil in a compressor in said refrigerating cycle, and thereby the above problems can be solved.

Further, preferably said adiabatic box can comprise an outer casing made of a damping plate.

In addition, said adiabatic box can comprise an outer casing made of an iron plate to which a damping plate and/or a damping material are/is stuck. More preferably said damping plate is a damping steel plate.

Furthermore, preferably said oil cooler can utilize a sub-condenser provided between the compressor and a main condenser in the above-described refrigerating cycle or utilize a thermosiphon.

In addition, in the refrigerating unit as above described, said machine compartment covered with a damping plate can be preferably attached to said adiabatic box with a screw through a sealant.

Further, in a refrigerating unit of the above, said adiabatic box can comprise a heat insulator therewithin and an inner casing, and a sound absorbing material layer can be provided between the heat insulator and the inner casing.

Furthermore, in a refrigerating unit of the above, said door can comprise and heat insulator therewithin and a door panel, and a sound absorbing material layer can be provided between the heat insulator and the door panel.

In addition, in a refrigerating unit of the above, wherein the used refrigerant mainly consists of a HFC refrigerant or a HC refrigerant in the refrigerating cycle.

An example of the refrigerating unit according to the present invention is a refrigerator 1 comprising an adiabatic box 3 having a door to its opening, a machine compartment 4 in contact with said adiabatic box 3, and a refrigerating cycle wherein the machine compartment 4 is covered with a compressor base 7 made of a damping plate or a cover 6 made of a damping plate and is attached to the adiabatic box 3 with a mounting means so as to be sealed, and an oil cooler (18*a* or 18*b*) for cooling lubricating oil in a compressor 8 for the refrigerating cycle is provided.

According to the present invention, as a machine compartment 4 is covered with the compressor base 7 or the cover 6 made of a damping plate and is attached to the adiabatic box 3 so as to be sealed, noise or vibration generated by the compressor 8 and so on can be reduced. Noise from the refrigerator 1 itself can be removed effectively preferably by also constituting an outer casing 5 of the adiabatic box 3 by a damping plate and further preferably by constituting the outer casing 5 by a damping plate fixed with a screw through a sealant without welding.

However, as an outer casing 5 of an adiabatic box 3 is usually formed by roll forming, in case a damping plate such as a damping steel plate is used, a spring back is sometimes caused by action of resin or rubber included in a damping plate and as a result, forming with high precision is disabled. In such a case, the equal effect can be obtained by using a thick iron plate or by stick a damping plate or a damping material to important positions using an adhesive or a screw after roll forming using an iron plate.

In the meantime, as the machine compartment 4 covered with a damping plate is attached to the adiabatic box 3 with a screw through a sealant without welding, soundproofing and damping effect is enhanced. As the refrigerator 1 itself substantially generates no vibration and no noise according to such a method, noise generated by resonance between the refrigerator and a wall or a cabinet can be also removed.

A damping plate used according to the present invention is not particularly limited, for example a product on the market wherein a damping material or a sound absorbing material is inserted between thick iron plates or thick metallic plates may be used, and in the concrete, if a damping steel plate approximately 1.2 mm thick wherein rubber, a rubber composite or a resin composite is inserted between metallic plates, a thick iron plate approximately 1.5 to 2.5 mm thick or an iron plate to which a damping material is stuck is used, it can be readily handled manually and in addition noise and vibration can be readily controlled.

As a refrigerating unit according to the present invention is provided with an oil cooler (18*a* or 18*b*) for cooling lubricating oil in the compressor 8, heat can be efficiently released. An oil cooler according to the present invention is not particularly limited and for example, an oil cooler utilizing a sub-condenser provided between a compressor and a main condenser for a refrigerating cycle or utilizing a thermosiphon can be used.

In a refrigerating unit according to the present invention, noise generated by a flowing or boiling refrigerant in an evaporator 11 can be absorbed and can be effectively removed by providing a sound absorbing material layer 24 between a heat insulator 22 in the adiabatic box 3 and an inner casing 10 of the adiabatic box.

Further, it is preferable that a sound absorbing material layer 24 is also provided between a heat insulator 22 inside a door 2 and a panel 9 of the door and as a result, noise generated inside a refrigerator is absorbed by the sound absorbing material layer 24 inside the door.

If a refrigerant mainly consisting of a HFC refrigerant or a HC refrigerant is used, a problem that an ozone layer is destroyed by a refrigerant is solved.

As in a refrigerating unit according to the present invention, a machine compartment is covered and sealed with a damping plate and is attached to an adiabatic box with a screw through a sealant, an oil cooler for cooling lubricating oil in a compressor is provided, and preferably an outer casing of the adiabatic box is also constituted by a damping plate, or a damping plate or a damping material is stuck to an important position of the outer casing of the adiabatic box after roll forming using an iron plate, noise and vibration generated by a refrigerator itself such as a compressor can be effectively attenuated, noise and vibration generated by resonance between a refrigerator and a wall or a cabinet can be attenuated and further the efficiency of heat release can be enhanced.

It is preferable that in a refrigerating unit according to the present invention, a sound absorbing material layer is provided between a heat insulator in an adiabatic box and an inner casing of the adiabatic box and between a heat insulator in a door and a panel of the door and as a result, noise generated by a flowing or boiling refrigerant in a evaporator can be absorbed by the sound absorbing material layer and can be effectively attenuated.

When a refrigerating unit according to the present invention is used at home or in a hotel or an inn, it can provide comfort in a bedroom and so on where it is installed, and as a HFC refrigerant or a HC refrigerant can be used and it has simple structure, the above-described system is economical, has a great effect and has a high industrial utility value.

DETAILED DESCRIPTION OF THE PREFERRED EMBODIMENTS

Referring to FIGS. 1 to 10, the contents of the present invention will be described further in detail below, however, the present invention is not limited to the following contents of embodiments.

Figure 1:
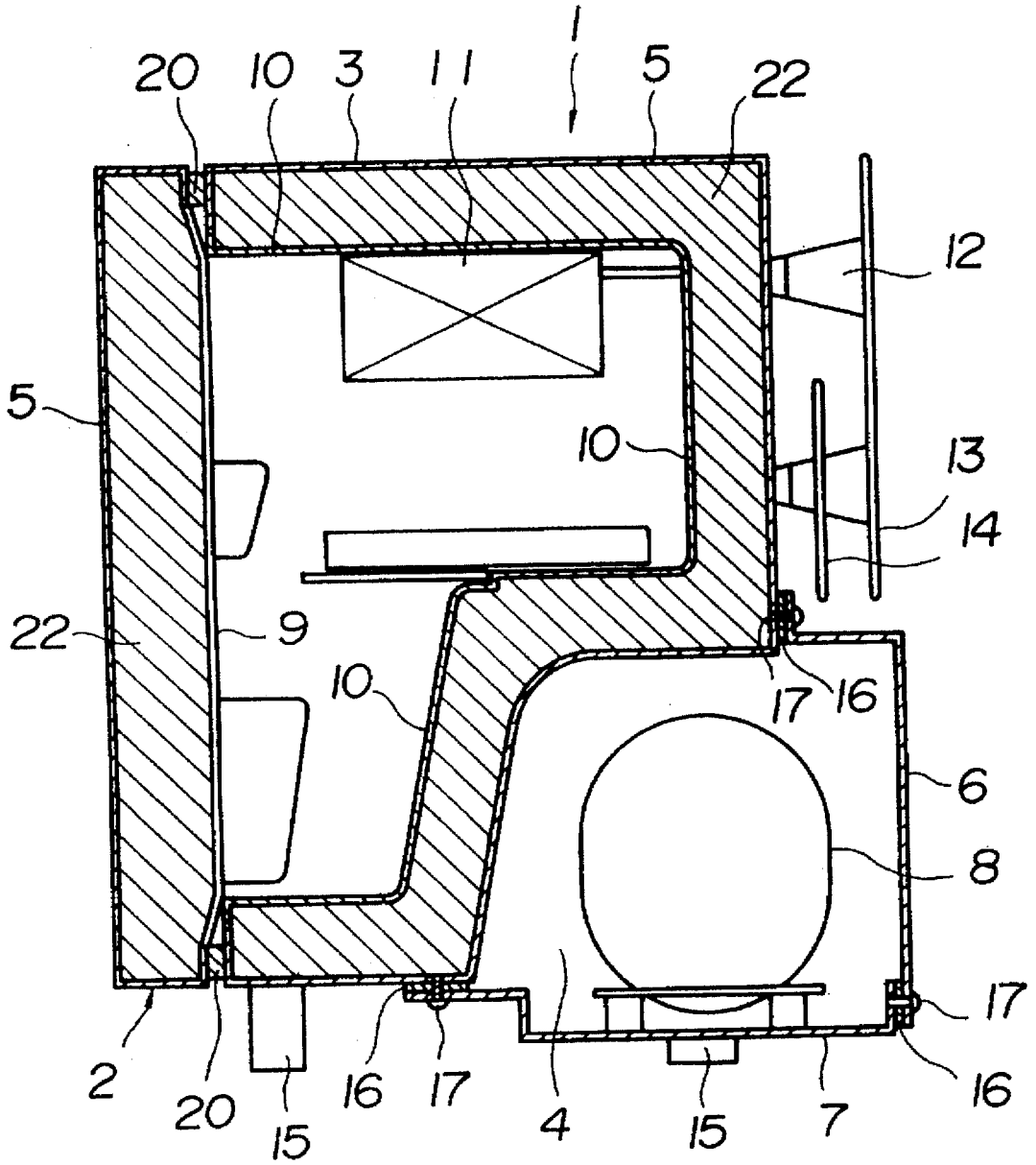
FIG. 1 is an explanatory drawing showing a longitudinal section of a refrigerating unit according to the present invention.

FIG. 1 is an explanatory drawing showing a longitudinal section of a refrigerator 1 for use in a hotel as an embodiment of a refrigerating unit according to the present invention. In the refrigerator 1, an adiabatic box 3 (a heat insulating wall) as the body of the refrigerator is formed by inserting an inner casing 10 at a fixed interval inside an outer casing 5 constituted by a damping plate which is open forward and filling a heat insulator 22 such as urethane foam by a site-foaming method between both casings, and a front opening of the adiabatic box 3 is blocked by a door 2 of which outer casing is constituted by a damping plate, of which inside is filled with a heat insulator 22 and which is provided with a door panel 9 facing with the inside of the refrigerator so that the door can be opened or closed freely. An evaporator (a cooler) 11 constituting a part of a refrigerating cycle is mounted inside the adiabatic box 3 and the above-described inside of the refrigerator is cooled up to a predetermined temperature by the above-described cooler. A reference number 20 designates a door gasket.

A machine compartment 4 isolated from the above-described inside of the refrigerator by a heat insulating wall of the adiabatic box 3 is formed in the lower part of the refrigerator 1. This machine compartment 4 is blocked in the front side, the top, both right and left sides by the outer casing 5 forming the adiabatic box 3 and is covered with a compressor base 7 made of a damping plate and a cover 6 made of a damping plate covering the machine compartment 4 including a compressor 8, the machine compartment 4 is attached to the adiabatic box 3 with a screw through a sealant 16 provided along a joint to the adiabatic box 3, the bottom of the machine compartment 4 is blocked by the compressor base 7 made of a damping plate, and the machine compartment 4 is sealed lest noise in the machine compartment 4 should leak outside the refrigerator through a gap. A reference number 15 designates a leg or a caster made of rubber or resin.

The compressor 8 constituting a part of a refrigerating cycle is mounted in this machine compartment 4. The compressor 8 is driven by a motor inside the compressor and various compressors such as a reciprocating type, a rotary type and a scroll type are applied.

Refrigerating machine oil in an oil reservoir (not shown) in the compressor 8 is cooled by an oil cooler 18*a*.

Figure 2:
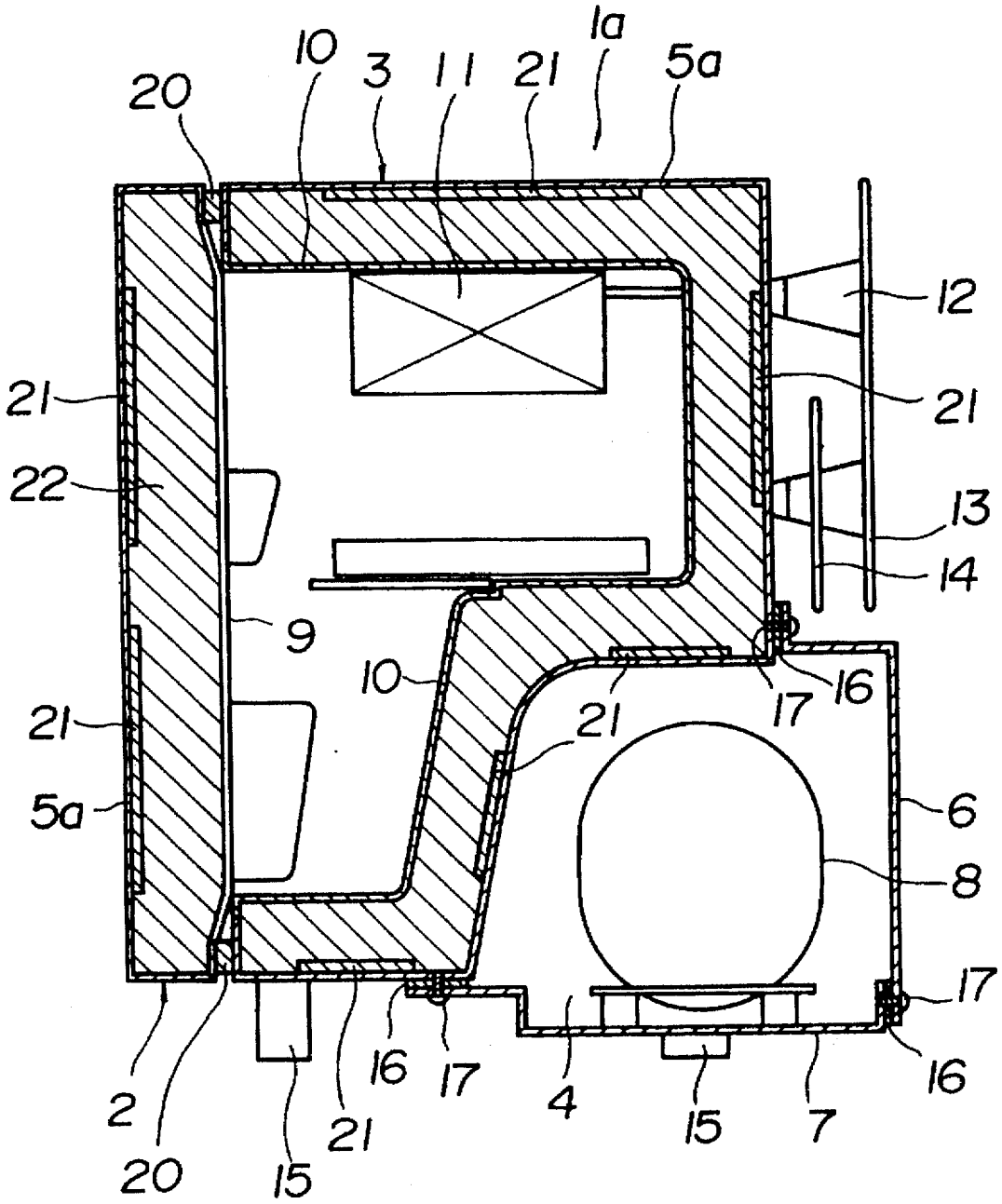
FIG. 2 is an explanatory drawing showing a longitudinal section of another refrigerating unit according to the present invention.

FIG. 2 is an explanatory drawing showing a longitudinal section of another refrigerating unit according the present invention. This refrigerating unit 1*a* is formed according to the same method as a refrigerator shown in FIG. 1 except that an outer casing 5*a* is formed by sticking a damping material 21 to important positions after roll forming using an iron plate and a door 2 is formed by the same method.

Figure 3:
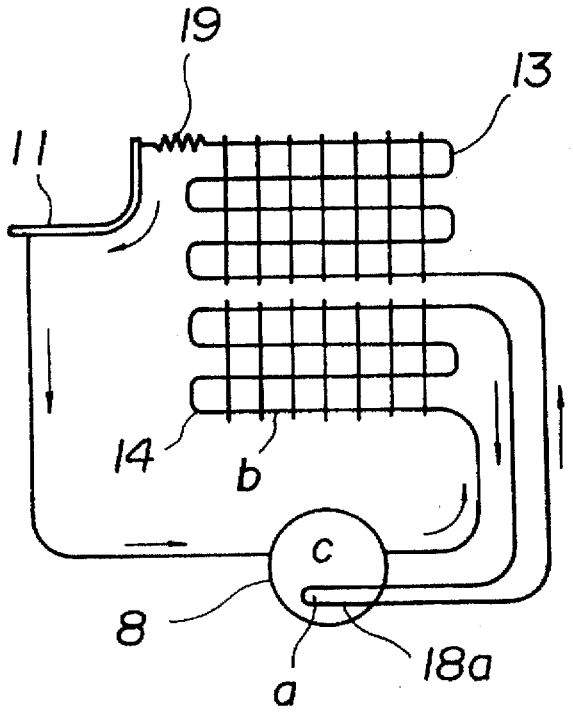
FIG. 3 shows a refrigerating cycle of a refrigerating unit according to the present invention.

FIG. 3 shows an example of a refrigerating cycle of a refrigerating unit according to the present invention. A reference number 8 designates a compressor for compressing an evaporated refrigerant and discharging it into a sub-condenser 14 and a main condenser 13, the sub-condenser 14 and the main condenser 13 are condensers for condensing and liquefying a refrigerant, a reference number 19 designates a capillary tube for reducing pressure, a reference number 11 designates an evaporator for evaporating a liquefied refrigerant, and an arrow shows flow of a refrigerant.

An oil cooler 18*a* is formed by disposing a part of a pipeline for a refrigerating cycle in the oil reservoir of the compressor 8 so that heat may be exchanged so as to use a refrigerant cooled and as a result, liquefied by the sub-condenser 14 as a medium for cooling lubricating oil in the compressor 8. An endothermic portion a of the oil cooler 18*a* is disposed in the oil reservoir of the compressor 8 so that heat may be exchanged. The oil cooler 18*a* is extended upward and outside the machine compartment 4 and fixed on a back plate of the outer casing 5 with a fixture 12 (see FIG. 1). A heat releasing portion b in the upper part is wound and fixed so that heat there is exchanged with that of the air.

When the motor of the compressor 8 is driven while cooling operation is performed, a high-temperature and high-pressure gaseous refrigerant is discharged from the compressor 8, the refrigerant cooled and liquefied by the sub-condenser 14 is gasified after cooling lubricating oil, this gasified refrigerant is again cooled and liquefied by the main condenser 13 and flows into the cooler 11 after the pressure is reduced in the capillary tube 19 for cooling, and thereby the inside of the refrigerator is cooled. In the meantime, the compressor 8 is vibrated by drive of the motor and noise is generated from the pipeline for a refrigerant in the compressor 8 and the machine compartment 4.

As the machine compartment 4 is completely sealed from the outside by the compressor base 7 and the cover 6 made of a damping plate, noise and vibration generated by parts in the machine compartment 4 including the compressor 8 are satisfactorily absorbed or blocked by the adiabatic box 3, the compressor base 7 and the cover 6, and the volume and vibration leaking outside can be remarkably reduced.

In case the compressor base 7 and the cover 6 are jointed or the compressor base 7 and the cover 6 are attached to the adiabatic box 3, a method other than welding is preferable. For a method other than welding, a method using a screw 17 through a sealant 16 (see FIG. 1) can be given as an example. Vibration generated by the compressor 8 can be satisfactorily absorbed by such a method. As the outer casing 5 of the adiabatic box 3 is also made of a damping plate or of an iron plate to which a damping material 21 is stuck, noise and vibration generated by the refrigerator 1 itself are remarkably reduced. Thereby reduction of noise generated by the refrigerator 1 can be promoted more.

When the compressor 8 is operated, the compressor 8 is heated by heat from various sources as described above, however, as lubricating oil is efficiently cooled by the oil cooler 18*a* utilizing latent heat of vaporization and abnormal rise of temperature of the compressor 8 is solved, a failure such as sticking and burning of wiring can be also prevented from occurring.

As a blower and a ventilation flue are not required in the machine compartment 4 owing to a heat releasing action by the oil cooler 18*a* though they are required in the conventional refrigerator, the volume of the machine compartment 4 can be reduced and effective volume in the adiabatic box 3 can be expanded by it.

Figure 4:
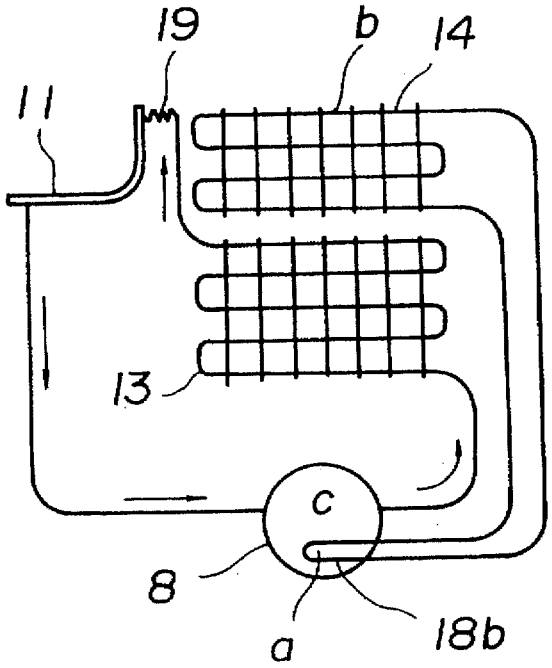
FIG. 4 shows another refrigerating cycle of a refrigerating unit according to the present invention.

FIG. 4 shows an example of another refrigerating cycle of a refrigerating unit according to the present invention. In other words, FIG. 4 shows an example of another oil cooler and the same reference number in FIG. 4 as that in FIGS. 1 to 3 designates the same thing as that in FIGS. 1 to 3. In this case, a thermosiphon is attached to the compressor 8 as an oil cooler 18*b*. This thermosiphon is constituted by sealing working fluid such as water, ethanol or fleon in a loop constituted by a pipe made of, for example iron or copper. The above-described working fluid in a saturated condition absorbs heat in a reservoir for lubricating oil, is evaporated, rises upward, releases heat by natural heat release on the side of the condensation and performs a condensing action.

The above-described endothermic portion a on the side of the above-described evaporation in the lower part of such a thermosiphon is disposed in the above-described oil reservoir of the compressor 8 so that heat is exchanged. The thermosiphon is extended upward and outside the machine compartment 4 by a method such as attaching with a screw through a sealant and fixed on a back plate of the outer casing 5 with a fixture 12 (see FIG. 1). A heat releasing portion b on the upper side of condensation is wound and fixed in the position where heat there is exchanged with that of the air.

Working fluid in the thermosiphon on the side a of evaporation absorbs heat from the compressor 8, is evaporated, rises upward and flows into the side b of condensation. As the side b of condensation is fixed in the position where heat there is exchanged with that of the air on a back plate of the outer casing 5 made of a damping plate with a fixture (not shown), working fluid is condensed by the air and simultaneously heat absorbed from the compressor 8 is discharged in the air. Thereby abnormal rise of temperature of the compressor 8 as described above is solved. As the machine compartment 4 is sealed as in the case of the above, noise is remarkably reduced similarly.

Figure 5:
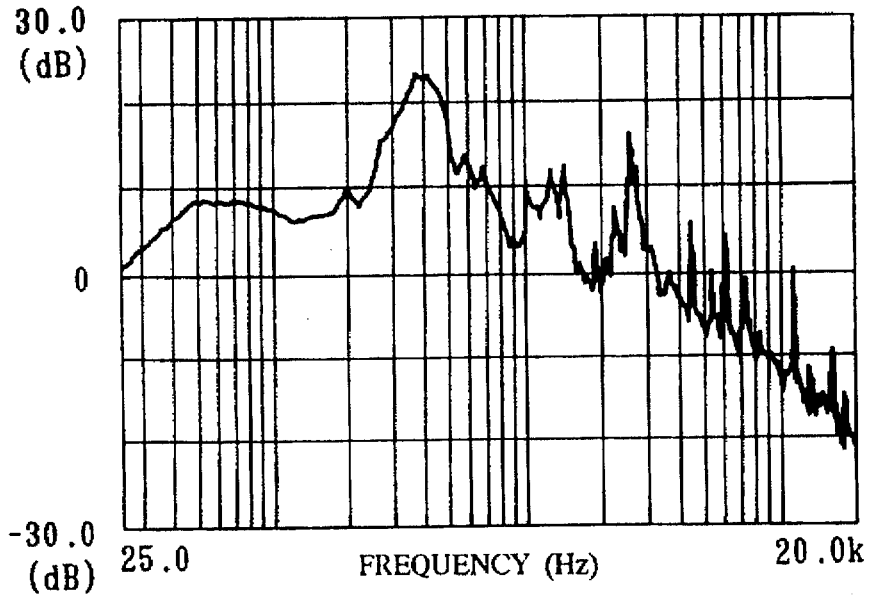
FIGS. 5(*a*) and 5(*b*) are graphs showing the relationship between noise and a frequency.
Figure 5:
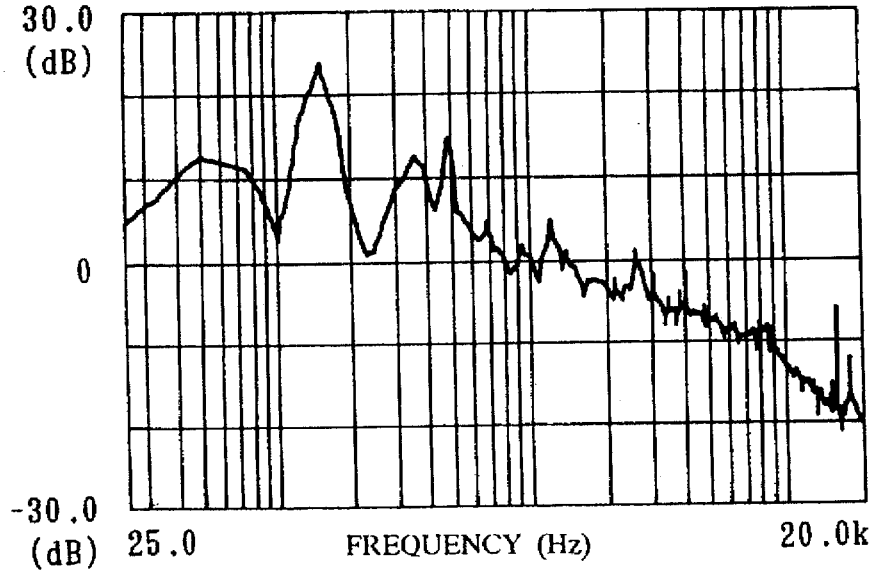

FIG. 5(*b*) shows the measured result of noise and vibration when a refrigerator for use in a hotel using a refrigerant consisting of 1,1,1,2-tetrafluoroethane (HFC-134a) being a HFC refrigerant wherein a machine compartment 4 was completely covered with a compressor base 7 (1.2 mm thick) made of a damping plate and a cover 6 (1.2 mm thick) made of a damping plate for covering the machine compartment 4 was installed in a furniture-like cabinet. FIG. 5(*a*) shows the result when the cover 6 was removed in the above-described case for comparison. The drawing shows noise 5 dB or more is reduced at a characteristic A (a level of noise audible to an ear of a man) of characteristics of noise by attachment of the cover 6. The effect produced by attachment of the cover 6 made of a damping plate for covering the machine compartment 4 is great as described above and attachment of the cover has an effect on the entire frequency band including higher frequency 200 Hz to 20 kHz.

Further, noise was measured for a refrigerator installed in a wooden cabinet not provided in JIS C9607, "Electric refrigerator" in consideration of actual use. The wooden cabinet larger 20 cm in width, height and depth than a refrigerator to be measured was used. Measurement was taken according to a noise test described in JIS C9607, "Electric refrigerator" except that a refrigerator was installed in a wooden cabinet.

Figure 6:
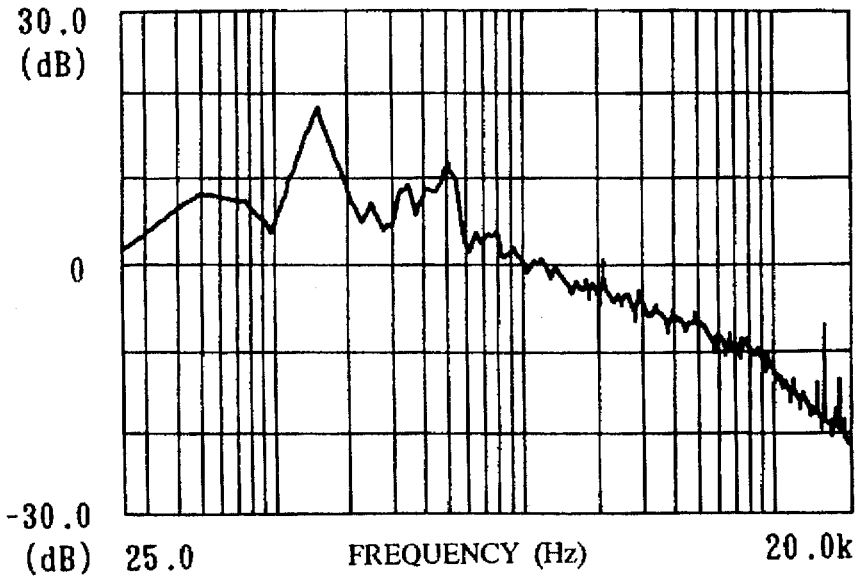
FIGS. 6(*a*) and 6(*b*) are further graphs showing the relationship between noise and a frequency.
Figure 6:
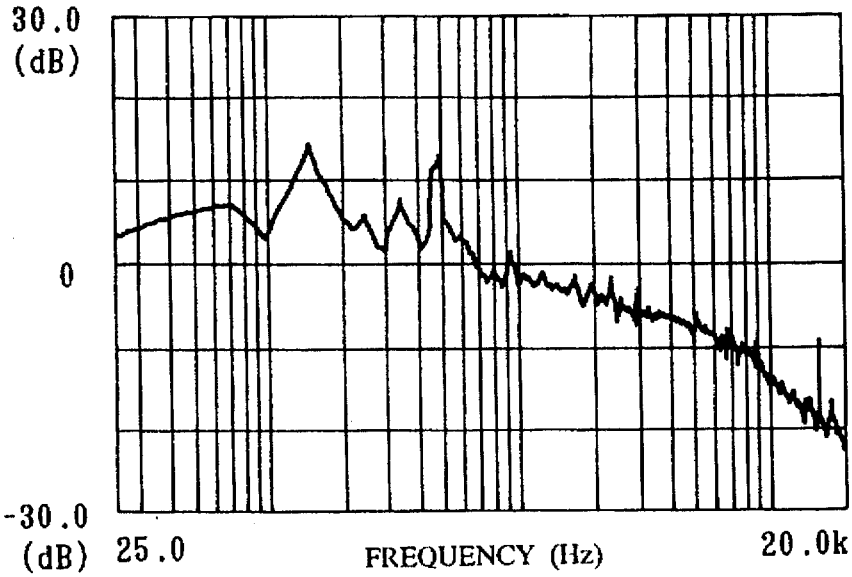

FIGS. 6(*a*) and 6(*b*) show the similarly measured result of noise and vibration of a refrigerator for use in a hotel using the above-described HFC refrigerant wherein a machine compartment 4 was sealed by a compressor base 7 (1.2 mm thick) made of a damping plate and a cover 6 (1.2 mm thick) made of a damping plate for covering the machine compartment 4 lest noise should leak and a damping material was also stuck to an outer casing 5*a* of an adiabatic box 3. FIG. 6(*a*) shows a case that an outer casing was made of an iron plate and FIG. 6(*b*) shows a case that an outer casing was made of a damping plate. Both drawings show particularly, noise 300–400 Hz and 700–900 Hz generated by a refrigerant is reduced.

Figure 7:
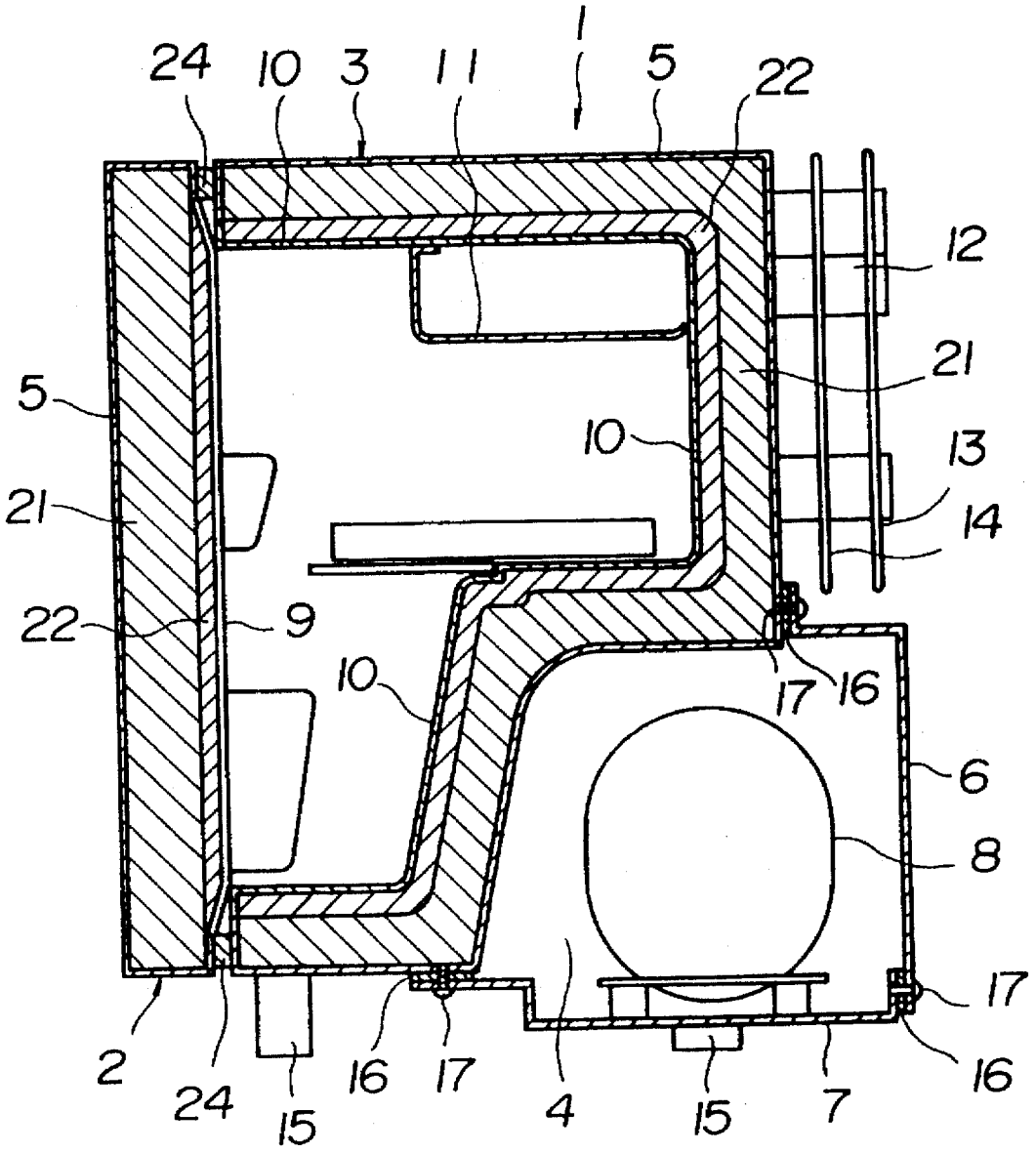
FIG. 7 is an explanatory drawing showing a longitudinal section of the other refrigerating unit according to the present invention.

FIG. 7 is an explanatory drawing showing a longitudinal section of a refrigerator 1*b* for use in a hotel as an embodiment of another refrigerating unit according to the present invention. In the refrigerator 1*b*, an adiabatic box 3 (a heat insulating wall) as the body of the refrigerator is formed by inserting an inner casing 10 at a fixed interval inside an outer casing 5 made of a damping plate which is open forward and filling a heat insulator 22 such as polyurethane foam between both casings by a side-foaming method, and the front opening of this adiabatic box 3 is blocked by a door 2 of which outside is made of a damping plate and of which inside is filled with a heat insulator 22 so that the door can be opened or closed freely. An evaporator (cooler) 11 constituting a part of a refrigerating cycle is mounted in the adiabatic box 3 and the above-described inside of the refrigerator is cooled up to predetermined temperature by the above-described cooler. A reference number 20 designates a door gasket.

In addition, a sound absorbing material layer 24 are provided between a heat insulator 22 in the adiabatic box 3 and an inner casing 10 of the adiabatic box. Furthermore, another sound absorbing material layer 24 is also provided between a heat insulator 22 inside a door 2 and a panel 9 of the door 2. Thereby noise generated by a flowing or boiling refrigerant in an evaporator 11 can be absorbed and can be effectively removed.

A sound absorbing material used according to the present invention may be made of organic and inorganic material or may be formed by combination of these and is particularly not limited if only it is made of material with a high sound absorption coefficient and can be used in a refrigerating unit according to the present invention. For a sound absorbing material consisting of organic material, for example in the concrete, rubber, a rubber composite, plastic, a plastic composite or foam of these can be given, and for a sound absorbing material consisting of inorganic material, for example in the concrete, glass wool, glass balloon, rock wool or inorganic foam can be given. The thickness, the shape of a sound absorbing material used according to the present invention, combination of sound absorbing materials and a method to attach a sound absorbing material layer are also particularly not limited and it is preferable that they are determined in consideration of absorption of noise, prevention of echo and reduction of reverberation time.

A machine compartment 4 isolated from the above-described inside of the refrigerator by a heat insulating wall of the adiabatic box 3 is formed in the lower back part of the refrigerator 1*b*. The front face, the top and both right and left sides of this machine compartment 4 are blocked by an outer casing 5 forming the adiabatic box 3, they are covered with a compressor base 7 made of a damping plate and a cover 6 made of a damping plate for covering the machine compartment 4 including a compressor 8, the machine compartment 4 is attached to the adiabatic box 3 with a screw 17 through a sealant 16 provided along a joint to the adiabatic box 3, the bottom of the machine compartment 4 is blocked by the compressor base 7 made of a damping plate and sealed lest noise should leak through a gap. A reference number 15 designates a leg or a caster made of rubber or resin.

The compressor 8 constituting a part of a refrigerating cycle together with the above-described cooler is mounted in this machine compartment 4. This compressor 8 is driven by a motor in it and various compressors such as a reciprocating type, a rotary type and a scroll type are applied.

Figure 8:
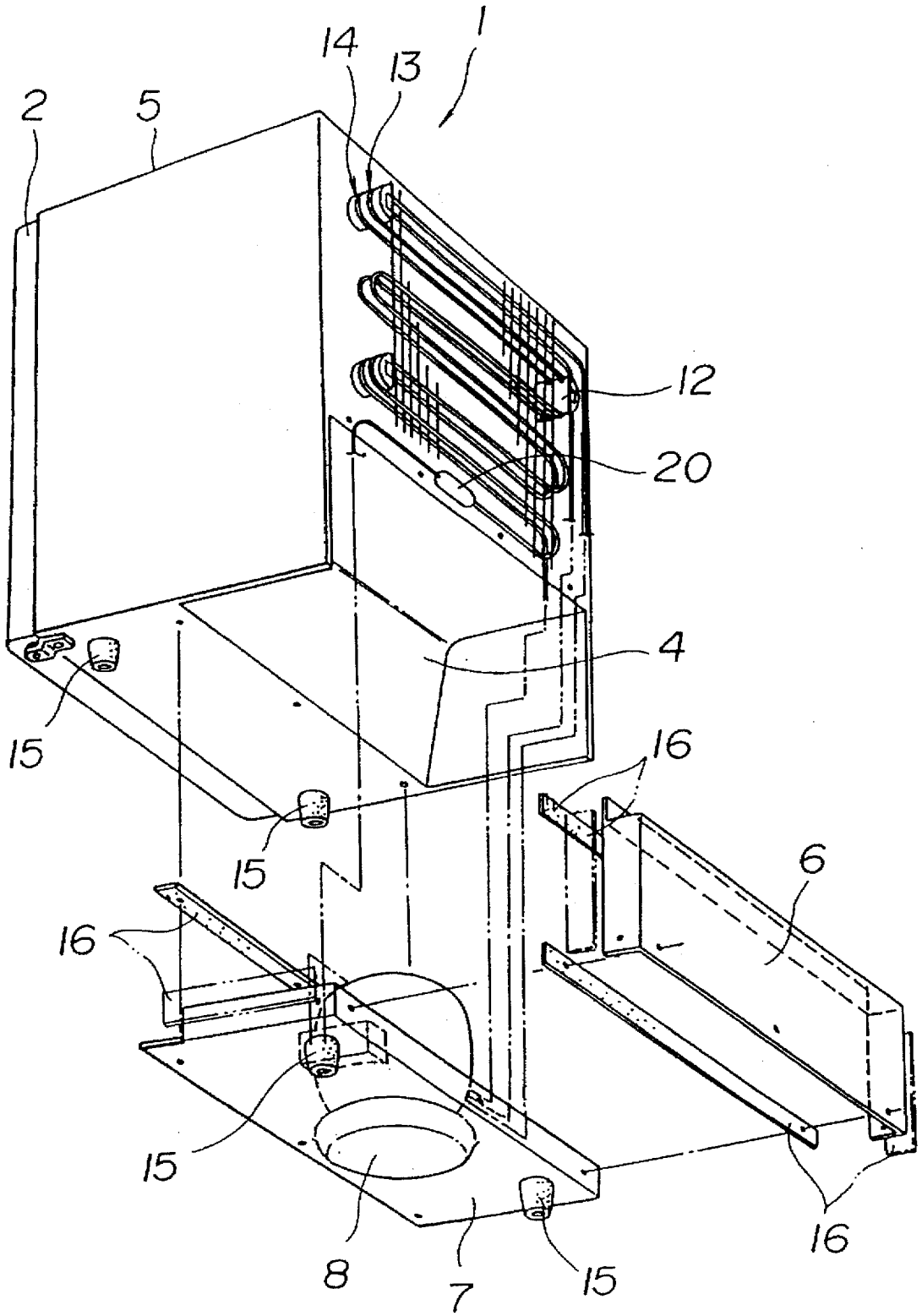
FIG. 8 is an exploded perspective view showing an assembling method of a refrigerating unit according to the present invention.

FIG. 8 is an exploded perspective view showing an assembling method of a refrigerator 1*b* for use in a hotel as an embodiment of a refrigerating unit according to the present invention. The same reference number as that in FIG. 1 designates the same thing as that in FIG. 1. A machine compartment 4 is covered with a compressor base 7 made of a damping plate and a cover 6 made of a damping plate for covering the machine compartment 4 including a compressor 8, is attached to an adiabatic box with a screw 17 through a sealant 16 provided along a joint to the adiabatic box 3, and the bottom of the machine compartment 4 is blocked by the compressor base 7 made of a damping plate and sealed lest noise should leak from a gap. A reference number 23 designates a drier.

Lubricating oil in an oil reservoir (not shown) in the compressor 8 is cooled by the above-described oil cooler 8*a* (not shown).

Figure 9:
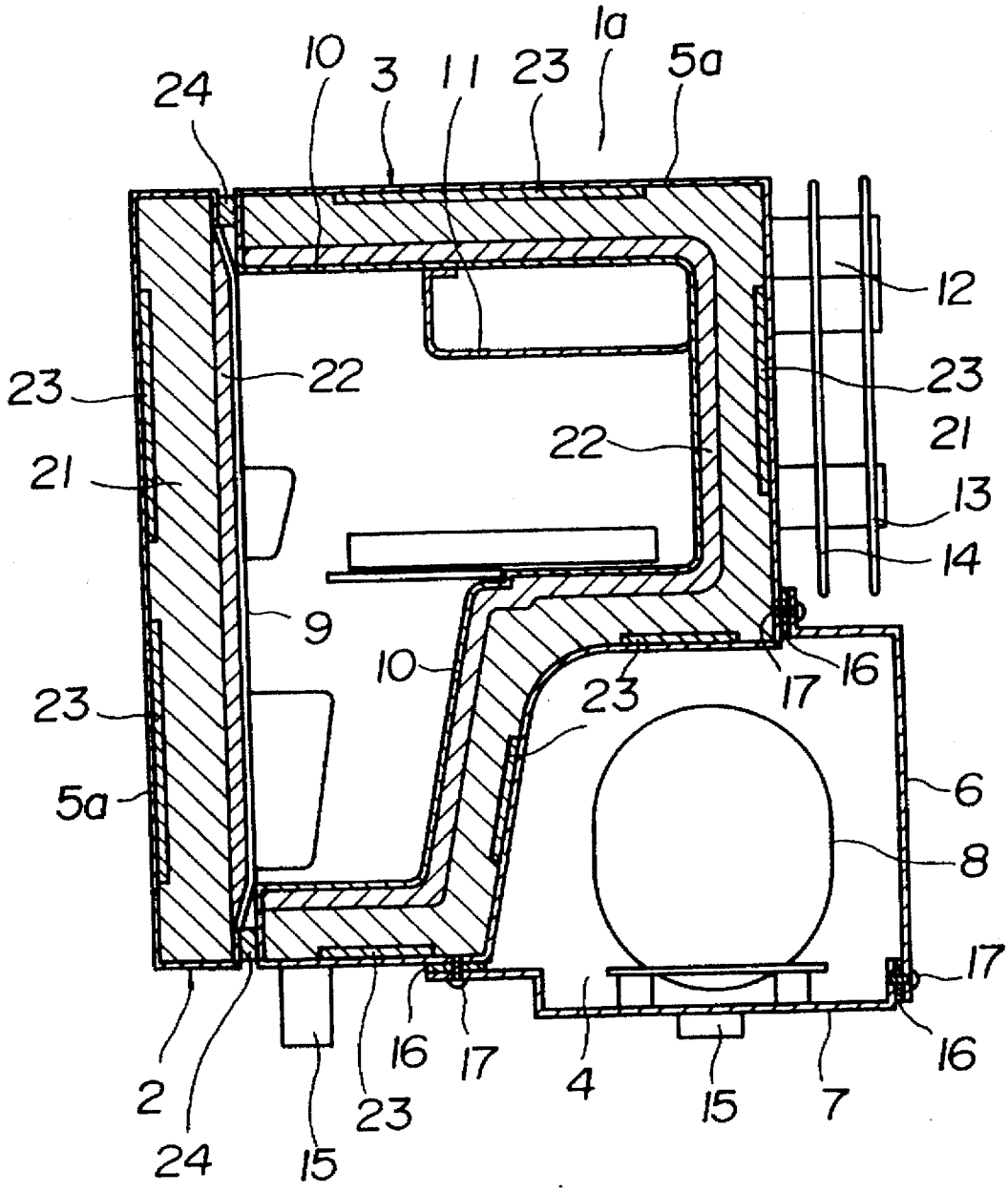
FIG. 9 is an explanatory drawing showing a longitudinal section of further the other refrigerating unit according to the present invention.

FIG. 9 is an explanatory drawing showing a longitudinal section of further the other refrigerating unit according to the present invention. This refrigerating unit 1*c* is formed as the refrigerating unit shown in FIG. 7 except that a damping material 21 is stuck to important positions of an outer casing 5*a* after roll forming using an iron plate and a door is formed similarly.

For an example of a refrigerating cycle for refrigerating units according to the present invention shown in FIGS. 7 to 9, the same refrigerating cycle as that shown in FIG. 3 or 4 can be given.

Figure 10:
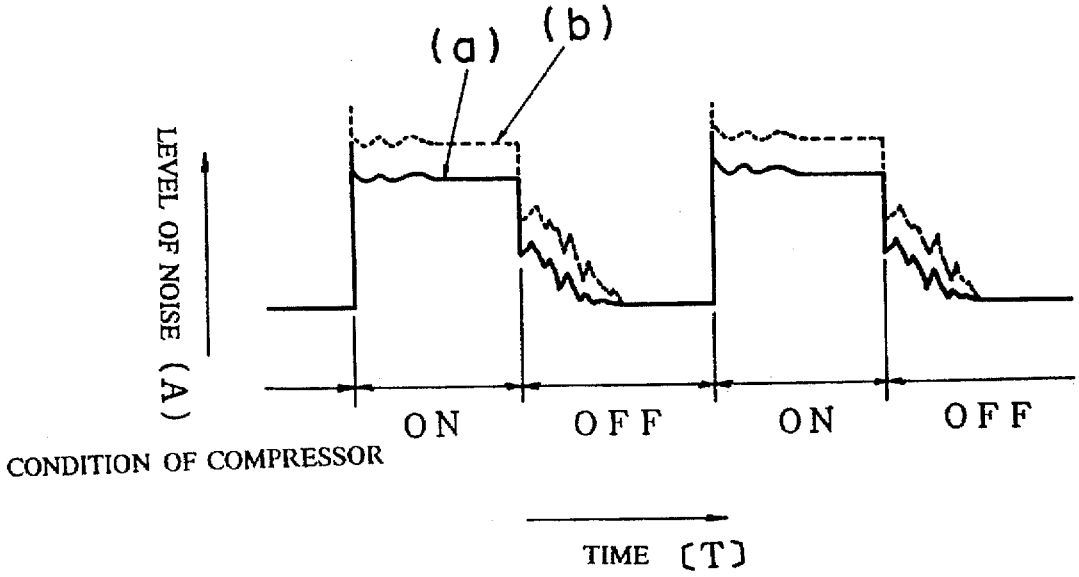
FIG. 10 is another graph showing the relationship between noise and a frequency.

FIG. 10(*a*) shows the measured result of noise and vibration in the range of frequencies 20 Hz to 20 kHz when a compressor was operated so as that turning it on and off was repeated in the refrigerator for use in a hotel using a refrigerant consisting of 1,1,1,2-tetrafluoroethane (HFC-134a) being a HFC refrigerant wherein a sound absorbing material layer (glass wool) 24 was provided between a heat insulator 22 in an adiabatic box 3 and an inner casing 10 and between a heat insulator 22 in a door 2 and a door panel 9, and a machine compartment 4 was covered with a compressor base 7 (1.2 mm thick) made of a damping plate and a cover 6 (1.2 mm thick) made of a damping plate for covering the machine compartment 4 lest noise should leak from a gap. FIG. 10(*b*) shows the measured result in case a sound absorbing material layer was not provided for comparison.

The drawing shows in case a sound absorbing material layer was not provided, noise in operation was large and noise generated by a refrigerant immediately was large after operation of the compressor was stopped by turning it off. Further, noise was measured as described above.

In the above-described embodiments, an oil cooler utilizing a sub-condenser and an oil cooler utilizing a thermosiphon are described, however, an oil cooler is not limited to them and the equal effect of heat release can be desired even if a heat pipe is utilized. In the above-described embodiments, a refrigerator for use in a hotel is described, however, a refrigerating unit according to the present invention is not limited to a refrigerator for use in a hotel and the present invention is effective in a show-case and a refrigerator for business use. For a refrigerant, a HFC refrigerant such as HFC-32 and HFC-125, a HC refrigerant such as propane, butane and pentane or a mixture thereof may be used in addition to the above-described HFC-134a.

What is claimed is:

1. A refrigerating unit comprising an adiabatic box provided with a door to its opening, a machine compartment in contact with said adiabatic box, and a refrigerating circuit comprising a compressor mounted in said machine compartment, an evaporator mounted in said adiabatic box, and a condenser mounted on an outer backside of said adiabatic box, said compressor, said evaporator and said condenser being interconnected with pipes, wherein:

said adiabatic box comprises an outer casing made of an iron plate to which a damping plate and damping material is stuck;

said machine compartment is covered with the damping plate and is attached to said adiabatic box with a mounting means so as to be sealed; and said refrigerating unit further comprises an oil cooler for cooling lubricating oil provided between said condenser and compressor, a part of said oil cooler disposed within said lubricating oil in the compressor.

2. A refrigerating unit according to claim 1 wherein said oil cooler utilizes a sub-condenser provided between the compressor and a main condenser in the above-described refrigerating circuit.

3. A refrigerating unit according to claim 1, wherein said machine compartment covered with a damping plate is attached to said adiabatic box with a screw through a sealant.

4. A refrigerating unit comprising an adiabatic box provided with a door to its opening, a machine compartment in contact with said adiabatic box, and a refrigerating cycle wherein:

said adiabatic box comprises a heat insulator therewithin and an inner casing, and a sound absorbing material layer is provided between the heat insulator and the door panel;

said machine compartment is covered with a damping plate and is attached to said adiabatic box with a mounting means so as to be sealed; and said refrigerating unit further comprises an oil cooler for cooling lubricating oil in a compressor wherein a portion of said refrigerating circuit is disposed within said lubricating oil.

5. A refrigerating unit comprising an adiabatic box provided with a door to its opening, a machine compartment in contact with said adiabatic box, and a refrigerating circuit, wherein:

said machine compartment is covered with a damping plate and is attached to said adiabatic box with a mounting means so as to be sealed;

said refrigerating unit further comprises an oil cooler for cooling lubricating oil in a compressor wherein a portion of said refrigerating circuit is disposed within said lubricating oil; and wherein said door comprises a heat insulator therewithin, a door panel, and a sound absorbing material layer provided between the heat insulator and the door panel.

6. A refrigerating unit according to claim 1, wherein said refrigerating circuit further utilizes a refrigerant mainly comprised of a component selected from the group consisting of HFC refrigerant and HC refrigerant.

7. A refrigerating unit comprising an adiabatic box provided with a door to its opening, a machine compartment in contact with said adiabatic box, and a refrigerating circuit, wherein:

said machine compartment is covered with a damping plate and is attached to said adiabatic box with a mounting means so as to be sealed;

said refrigerating unit further comprises an oil cooler for cooling lubricating oil in a compressor wherein a portion of said refrigerating circuit is disposed within said lubricating oil;

said adiabatic box comprises an outer casing made of an iron plate to which a damping plate and a damping material is stuck;

said damping plate is a damping steel plate;

said oil cooler utilizes a sub-condenser provided between the compressor and a main condenser in the above-described refrigerating circuit;

said machine compartment covered with the damping plate is attached to said adiabatic box with a screw through a sealant;

said adiabatic box comprises a heat insulator therewithin, an inner casing, and a sound absorbing material layer provided between the heat insulator and the inner casing;

said door comprises the heat insulator therewithin, a door panel, and a sound absorbing material layer provided between the heat insulator and the door panel; and said refrigerating circuit further utilizes a refrigerant mainly comprised of a component selected from the group consisting of HFC refrigerant and HC refrigerant.

8. A refrigerating unit comprising an adiabatic box provided with a door to its opening, a machine compartment in contact with said adiabatic box, and a refrigerating circuit, wherein:

said machine compartment is covered with a damping plate and is attached to said adiabatic box with a mounting means so as to be sealed;

said refrigerating unit further comprises an oil cooler for cooling lubricating oil in a compressor; and said adiabatic box comprises a heat insulator therewithin, an inner casing, and a sound absorbing material layer provided between the heat insulator and the inner casing;

wherein said oil cooler utilizes a thermosiphon in communication with said lubricating oil.

9. A refrigerating unit comprising an adiabatic box provided with a door to its opening, a machine compartment in contact with said adiabatic box, and a refrigerating circuit, wherein:

said machine compartment is covered with a damping plate and is attached to said adiabatic box with a mounting means so as to be sealed;

said refrigerating unit further comprises an oil cooler for cooling lubricating oil in a compressor;

said damping plate is a damping steel plate;

said oil cooler utilizes a thermosiphon in communication with said lubricating oil;

said machine compartment covered with the damping plate is attached to said adiabatic box with a screw through a sealant;

said adiabatic box comprises a heat insulator therewithin, an inner casing, a sound absorbing material layer provided between the heat insulator and the inner casing and an outer casing made of an iron plate to which the damping plate and damping material are stuck;

said door comprises a heat insulator therewithin, a door panel, and a sound absorbing material layer provided between the heat insulator and the door panel; and said refrigerating circuit further includes a refrigerant mainly comprised of a component selected from the group consisting of HFC refrigerant and HC refrigerant.

10. A refrigerating unit according to claim 2, wherein said sub-condenser is provided between said compressor and said oil cooler with respect to said refrigerating circuit.

11. A refrigerating unit according to claim 1, wherein said compressor includes an oil reservoir containing oil, wherein a portion of said refrigerating circuit is disposed within said oil reservoir thereby cooling said oil.

12. A refrigerating unit comprising an adiabatic box provided with a door to its opening, a machine compartment in contact with said adiabatic box, and a refrigerating circuit comprising a compressor mounted in said machine compartment, an evaporator mounted in said adiabatic box, and a condenser mounted on an outer backside of said adiabatic box, said compressor, evaporator and condenser being connected with pipes, wherein:

said adiabatic box comprises an outer casing made of a damping plate; said machine compartment is covered with a damping plate and is attached to said adiabatic box with a mounting means so as to be sealed; and said refrigerating unit further comprises an oil cooler for cooling lubricating oil provided between said condenser and compressor, a part of said oil cooler disposed within said lubricating oil in the compressor.

13. A refrigerating unit comprising an adiabatic box provided with a door to its opening, a machine compartment in contact with said adiabatic box, and a refrigerating circuit comprising a compressor mounted in said machine compartment, an evaporator mounted in said adiabatic box, and a condenser mounted on an outer backside of said adiabatic box, said compressor, evaporator and condenser being connected with pipes, wherein:

said adiabatic box comprises an outer casing made of a damping steel plate;

said machine compartment is covered with a damping plate and is attached to said adiabatic box with a mounting means so as to be sealed; and said refrigerating unit further comprises an oil cooler for cooling lubricating oil provided between said condenser and compressor, a part of said cooler is disposed within said lubricating oil in the compressor.

* * * * *